US005794717A

United States Patent [19]

Briggs et al.

[11] Patent Number: 5,794,717

[45] Date of Patent: Aug. 18, 1998

[54] ROCK DRILL PERCUSSION MECHANISM

[76] Inventors: Roger Robarts Briggs, 23 Leyes Lane, Kenilworth, Warwickshire, CU8 2OD, United Kingdom; Jarmo Uolevi Leppanen, c/o 11 Junction Road, Industries North, Germiston, 1401, South Africa

[21] Appl. No.: 532,579

[22] PCT Filed: Apr. 20, 1994

[86] PCT No.: PCT/GB94/00837

§ 371 Date: Oct. 20, 1995

§ 102(e) Date: Oct. 20, 1995

[87] PCT Pub. No.: WO94/23906

PCT Pub. Date: Oct. 27, 1994

[30] Foreign Application Priority Data

Apr. 21, 1993 [ZA] South Africa ..... 93/2780
Apr. 21, 1993 [ZA] South Africa ..... 93/2782

[51] Int. Cl.[6] ..... B25D 9/14

[52] U.S. Cl. ..... 173/206; 173/13; 173/128; 91/300; 91/321

[58] Field of Search ..... 173/206, 207, 173/208, 128, 13; 91/300, 321

[56] References Cited

U.S. PATENT DOCUMENTS 3,955,478 5/1976 Feucht ..... 173/206
4,070,949 1/1978 Salmi .
4,878,550 11/1989 Chuang ..... 173/207

*Primary Examiner*—Scott A. Smith
*Attorney, Agent, or Firm*—Jones, Tullar & Cooper, P.C.

[57] ABSTRACT

A rock drill with a percussion mechanism which includes a piston, a body in which is formed a chamber, at least a first cylinder which is located in the chamber and which, on an inner side, forms at least part of a sleeve for the piston, and a valve, for controlling movement of the piston, which is located on an outer side of the first cylinder. A stop structure integrally attached to the first cylinder prevents the valve from being removed.

14 Claims, 2 Drawing Sheets

ROCK DRILL PERCUSSION MECHANISM

BACKGROUND OF THE INVENTION

This invention relates generally to a rock drill percussion mechanism and more particularly to a valve arrangement for controlling reciprocating movement of a piston in a percussion drill.

The applicants are aware of a wide variety of percussion rock drills. These drills are usually made from a number of different sections which are bolted together and a chosen type o valve construction is used to control the flow, of hydraulic fluid which powers a reciprocating piston. It is for example known to make use of pilot controlled spool valves or pilot controlled check valves and mechanical valves.

Spool and check valves are riot easily built large enough in order to obtain the opening speed and immediate hydraulic fluid flows for the piston. This is critical particularly with large rock drills. Mechanical valves on the other hand, which are subjected to mechanical shocks, are easily damaged.

It is known for example from U.S. Pat. No. 4,070,949 to make use of a pilot sleeve type distributor valve which is positioned around the piston. This valve has the advantage of providing immediate hydraulic fluid float to the piston. On the other hand the piston is in close contact with the breaks, the valve and its casing will be damaged at the same time.

Other valve arrangements are described for example in the specifications of Swiss patent No. 559088 and of U.S. Pat. Nos. 4,852,664, 4,073,350 and 5,002,136.

FR-A-2 383 757 discloses a rock drill with a percussion mechanism according to the pre-characterising part of claim 1.

According to one aspect of the present invention, there is provided a rock drill with a percussion mechanism which includes a piston, a body in which is formed a chamber, a first cylinder which is located in the chamber, a second cylinder which is engaged with the first cylinder, and a valve, for controlling movement of the piston, which is located in a volume defined by opposing surfaces of the two cylinders, the first cylinder, on an inner side, forming at least part of a sleeve for the piston, and the valve being located on an outer side of the first cylinder and on an inner side of the second cylinder, characterised in that the valve is movable relatively to the first and second cylinders which are stationary relatively to the body, in that the valve is guided for movement between two limiting positions formed by respective shoulders, and in that stop means is provided to prevent the valve from being removed from the volume.

Ports can be provided through the cylinders for directing hydraulic fluid flow from and to the valve.

Preferably the stop means is integrally attached to at least one of the cylinders by means of at least one of the following: an adhesive, welding, fusion, an interference or friction fit, or by mechanical deformation of the stop means or at least one of the cylinders.

According to another aspect of the present invention, there is provided a method of assembling a control valve mechanism for a percussion drill, which is characterised in that it includes the steps of mounting a control valve in an operating space in a housing wherein the valve is guided for movement between two limiting positions formed by respective shoulders and integrally attaching stop means to the housing to prevent the control valve from being removed from the operating space.

For a better understanding of the invention and to show how the same may be carried into effect, reference will now be made, by way of example, to the accompanying drawing, in which:

FIG. 1 is a side view partly sectioned of a percussion mechanism for a rock drill according to the invention, and FIG. 2 is a side view partly sectioned of portion of the mechanism shown in FIG. 1, on an enlarged scale, and FIG. 3 is a view similar to FIG. 2 illustrating the way in which a control valve is secured in position according to the invention.

DESCRIPTION OF PREFERRED EMBODIMENT

Figure 1:
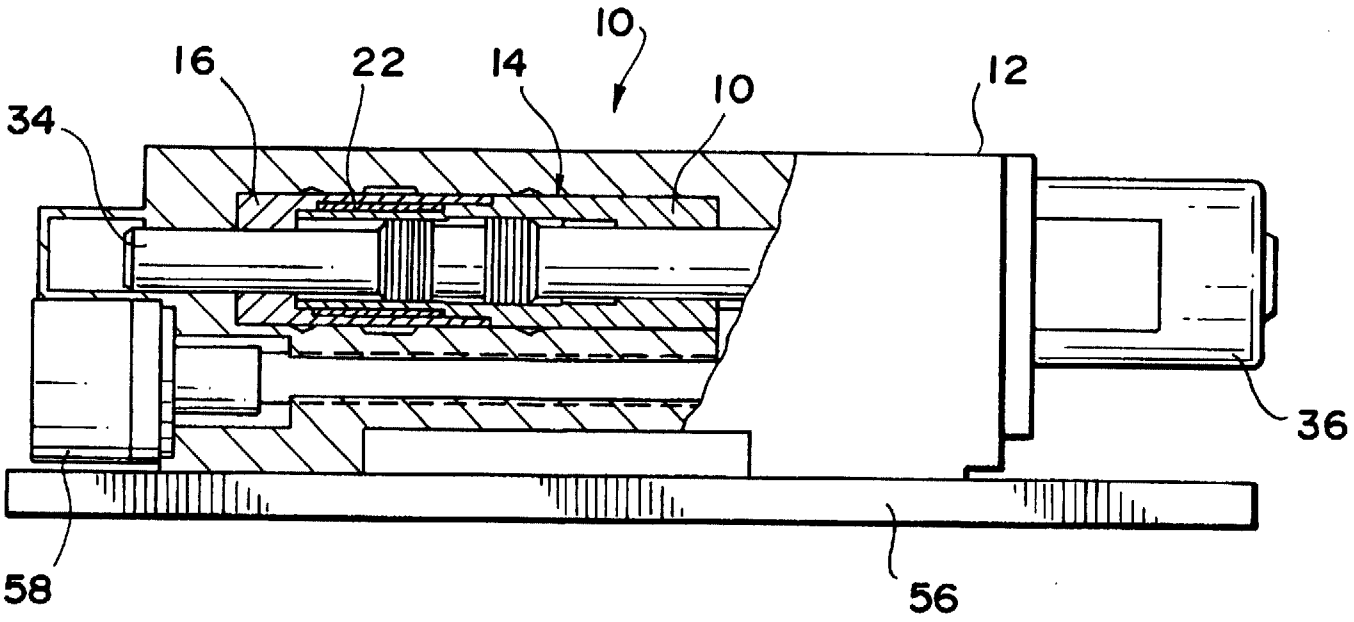
Figure 2:
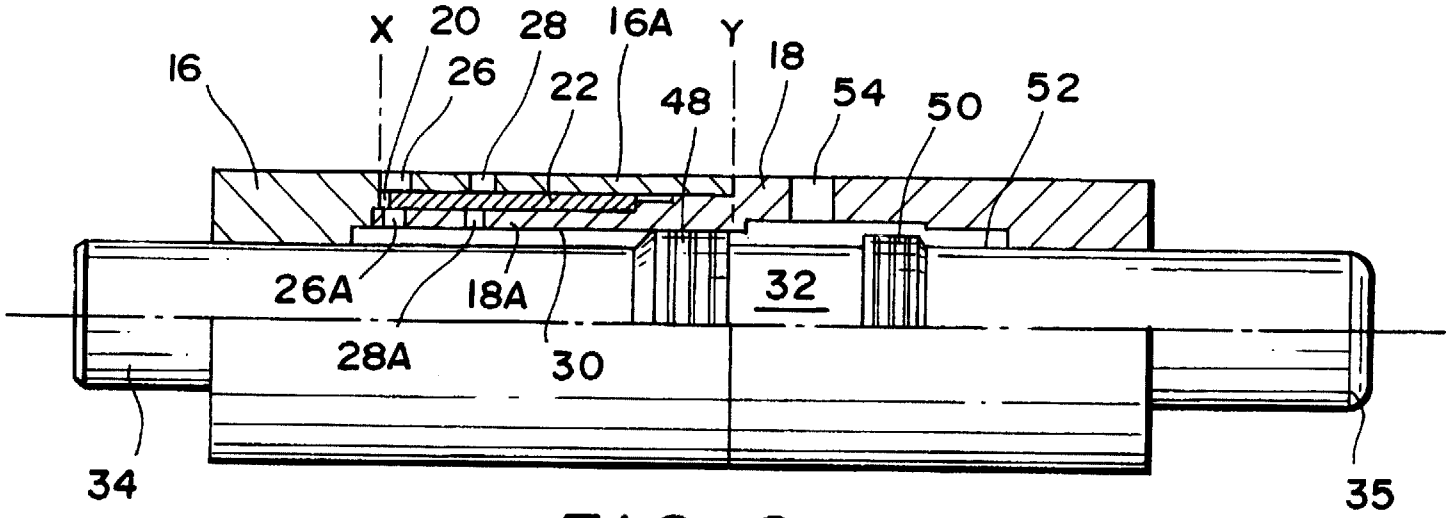

FIGS. 1 and 2 illustrate a percussion mechanism 10 for a rock drill according to the invention. The mechanism includes a main body 12 in which is formed a chamber 14. Located Inside the chamber are a rear cylinder 16 with a cylindrical section 16A and a front cylinder 18 with a reduced diameter section 18A.

The cylinders are inter-engageable with one another, as is seen more clearly in FIG. 2. The sections 16A and 18A define between them a volume 20. A reciprocating cylindrical distribution valve 22 is positioned inside the volume 20.

The two cylinders include ports 26 and 28 and 26A and 28A respectively.

An inner surface of the front cylinder 18 forms part of a sleeve 30 for a piston 32. As shown in FIG. 2 opposing ends 34 and 35 of the piston extend from opposing ends of the chamber 14 in the main body 12. A drill shank engaging part 36, see FIG. 1, is located on the right hand side of the body, to be contacted by the end 35 of the piston 32.

The piston 32 has two spaced lands 48 and 50. A port 54 is provided through the front cylinder and feeds hydraulic oil to a front side of the land 50.

FIG. 1 illustrates the body 12 mounted to a cradle 56. Apparatus 58 for imparting rotary movement to the drill shank engaging part 36 is mounted to the body 12. The apparatus 58 functions in a known manner which is not relevant to an understanding of the present invention.

The valve 22 is used as a distributor valve to control the flow of hydraulic fluid from a suitable hydraulic source through the ports 26 and 20A, into the annular space inside the sleeve 30 to the left of the land 46, see FIG. 2, and to return flow from the annular space via the ports 28 and 28A. The annular area on the left hand side of the land 48, extending around the shank of the piston 32, is relatively large. The annular area in front of the land 50 is relatively smaller. By having both annular areas pressurized simultaneously the piston works like a hydraulic differential cylinder forcing the piston forwards delivering a blow to the part 36 and hence to a drill shank which is engaged with the part 36. During the blow the valve 22 reacts and changes its location. The pressure is released behind the land 48. Fluid entering the port 54 then drives the piston to the left, on its return stroke, for the forces on the opposing annular areas of the lands 48 and 50 are counter balanced and there is a net force due to the pressure acting on the annular area on the right hand side of the land 50.

While the piston moves on its return stroke fluid held within the sleeve 30, to the left of the land 48, is expelled through the ports 28A and 28. The valve is then again switched and pressure fluid Is admitted through the ports 26 and 26A to drive the piston on a percussion stroke.

It is to be noted that the valve 22 is located in the volume 20 which is formed between opposing surfaces of the rear and front cylinders 16 and 18 respectively. The valve is therefore not in contact with the piston which is rotating, and reciprocating at a high frequency of from 40 Hz to 60 Hz. Wear on the valve is therefore reduced. Tolerances between the valve 22 and cylinders 18 and 16 can be minimized reducing oil leakages and heat build up.

The opening speeds for the oil channels between the ports 26 and 26A and 28 and 28A are high due to the large circular surface of the valve 22. The fast opening speed rapidly accelerates the piston and increases percussion power and efficiency.

If the piston should fail then damage may be caused to the cylinder 18 but it is unlikely that the cylinder 16 or valve 22 will be damaged.

A possible modification to the mechanism is to replace the cylinders 16 and 18 by three or more components. For example the cylinder 16 can be separated into two components along a plane X, while the cylinder 18 can also be separated into two components along a plane Y. Modifications of this type, which ease the manufacture of the construction, are intended to fall inside the scope of the invention.

Figure 3:
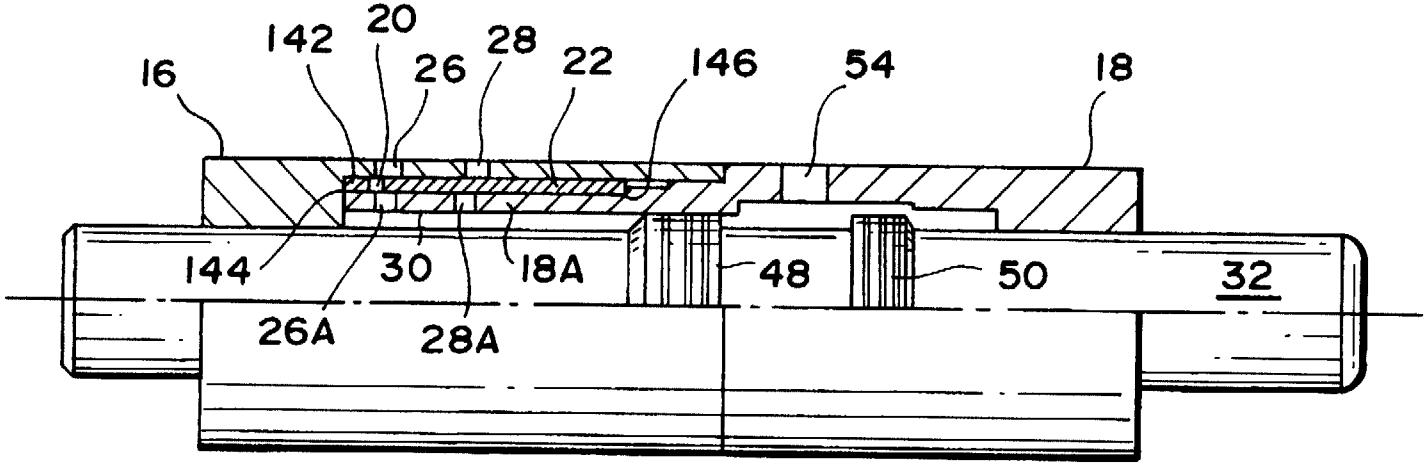

FIG. 3 is similar in many respects to FIG. 2 and like reference numerals are therefore used to Indicate like components. Differences in construction are described hereinafter.

A stop piece 142 is positioned on the section 18A, at one end of the section, and is precisely secured thereto by means of any suitable process for example by one or more of the following: welding, fusion, an adhesive, a friction or interference fit, or by mechanical deformation of one or both respective components. In this example the components may be welded or fused together along a line designated by the numeral 144. The stop piece 142 is placed in position on the section 18A, and secured thereto, only after the valve 22 has been placed on the section 18A. The stop price is precisely positioned relatively to the section 18A to ensure that the stroke of the valve 22 is accurately determined. It is to be noted that, on the left hand side of the section 18A, the stop piece 142 forms a shoulder which prevents further movement of the valve 22 to the left in the drawing while, on the right hand side of the section 18A, the cylinder 18 is formed integrally, in one piece, with a shoulder 146 which prevents movement of the valve, to the right in the drawing, beyond the shoulder.

It is essential for effective operation of the control valve mechanism to control the stroke of the valve 22 accurately to a predetermined stroke length. By securing the stop piece 142 to the section 18A in the manner described this objective can be achieved in a reliable manner. Further as the stop piece is integral, as defined, with the section 18A the stroke length of the valve is not affected by component tolerances, and forces which arise from vibrations or shock loadings imparted to the rock drill during use. This position is to be contrasted with what is the case with similar valves known to the applicants in which the valve stroke is determined by means of two or more components which are releasably secured to one another for example by means of bolts.

We claim:

1. A rock drill with a percussion mechanism which includes a piston, a body in which is formed a chamber, a first cylinder which is located in the chamber, a second cylinder which is engaged with the first cylinder, and a valve, for controlling movement of the piston, which is located in a volume defined by opposing surfaces of the two cylinders, the first cylinder, on an inner side, forming at least part of a sleeve for the piston, and the valve being located on an outer side of the first cylinder and on an inner side of the second cylinder, characterized in that the valve is movable relatively to the first and second cylinders which are stationary relatively to that the body, in that the valve is guided for movement between two limiting positions formed by respective shoulders, and in that stop means is provided to prevent the valve from being removed from the volume.

2. A rock drill according to claim 1, wherein ports are formed through the cylinders for directing hydraulic fluid flow from and to the valve.

3. A rock drill according to claim 2, wherein the valve is in slilding contact with a surface on the said outer side of the first cylinder and the shoulders extend at spaced locations from the surface.

4. A rock drill according to claim 2, wherein at least one shoulder is formed by securing a stop piece to the first and second cylinder.

5. A rock drill according to claim 4, wherein the other shoulder is formed in one piece with the first cylinder.

6. A rock drill according to claim 1, wherein the stop means is integrally attached to at least one of the cylinders by means of at least one of the following: an adhesive, welding, fusion, an interference or friction fit, or by mechanical deformation of the stop means or at least one of the cylinders.

7. A rock drill according to claim 6, wherein the valve is in sliding contact with a surface on the said outer side of the first cylinder and the shoulders extend at spaced locations from the surface.

8. A rock drill according to claim 6, wherein at least one shoulder is formed by securing a stop piece to the first and second cylinder.

9. A rock drill according to claim 8, wherein the other shoulder is formed in one piece with the first cylinder.

10. A rock drill according to claim 1, wherein the valve is in sliding contact with a surface on the said outer side of the first cylinder and the shoulders extend at spaced locations from the surface.

11. A rock drill according to claim 10, wherein at least one shoulder is formed by securing a stop piece to the first and second cylinder.

12. A rock drill according to claim 11, wherein the other shoulder is formed in one piece with the first cylinder.

13. A rock drill according to claim 1, wherein at least one shoulder is formed by securing a stop piece to the first and second cylinder.

14. A rock drill according to claim 13, wherein the other shoulder is formed in one piece with the first cylinder.

* * * * *